US007160847B2

(12) United States Patent
Huang et al.

(10) Patent No.: US 7,160,847 B2
(45) Date of Patent: Jan. 9, 2007

(54) WATER SOLUTION USING IN METAL SURFACE TREATING PROCESS AND PROCESS FOR REMOVING OXIDIZED FILM AND BURRED EDGE USING THE SAME

(75) Inventors: Ching-An Huang, Tao-Yuan (TW); Chun-Ching Hsu, Taipei (TW)

(73) Assignee: Chang Gung University, Tao-Yuan (TW)

( * ) Notice: Subject to any disclaimer, the term of this patent is extended or adjusted under 35 U.S.C. 154(b) by 383 days.

(21) Appl. No.: 10/434,900

(22) Filed: Apr. 22, 2003

(65) Prior Publication Data

US 2004/0211441 A1 Oct. 28, 2004

(51) Int. Cl.

| | |
|---|---|
| ***C11D 9/06*** | (2006.01) |
| ***C11D 9/42*** | (2006.01) |
| ***C11D 3/02*** | (2006.01) |
| ***C11D 7/02*** | (2006.01) |

(52) U.S. Cl. ..... 510/245; 510/248; 510/253; 510/254; 510/257; 510/263; 510/264; 510/269; 510/492; 510/499; 510/501

(58) Field of Classification Search ..... 510/245, 510/248, 253, 254, 257, 263, 264, 269, 492, 510/499, 501

See application file for complete search history.

(56) References Cited

U.S. PATENT DOCUMENTS

| | | | | |
|---|---|---|---|---|
| 3,954,645 | A * | 5/1976 | Otrhalek et al. | 134/3 |
| 2004/0211441 | A1 * | 10/2004 | Huang et al. | 134/2 |

FOREIGN PATENT DOCUMENTS

| | | | |
|---|---|---|---|
| GB | 1 407 269 | * | 9/1975 |
| JP | 48-52638 | * | 7/1973 |

* cited by examiner

*Primary Examiner*—Brian P Mruk
(74) *Attorney, Agent, or Firm*—Rosenberg, Klein & Lee

(57) ABSTRACT

A method for chemical etching is disclosed for taking away oxidized film and removing cut as well as punched edge burs of harden-treated carbon steel (SK3, SK4 and SK5). Thereby, the fillet edge of the cut section is achieved. An oxidized film with a thickness of several micrometers is formed when a cut and punched steel is quenched and tempered at high temperature. Due to high strength and hardness of the steel, the oxidized film and edge burs are difficult to be removed by mechanical grinding. Therefore, a suitable electrolyte composes of only a little chemical reagent and oxidizer in deionized water is used to remove the oxidized film and punched bur simultaneously using chemical etching method.

5 Claims, 6 Drawing Sheets

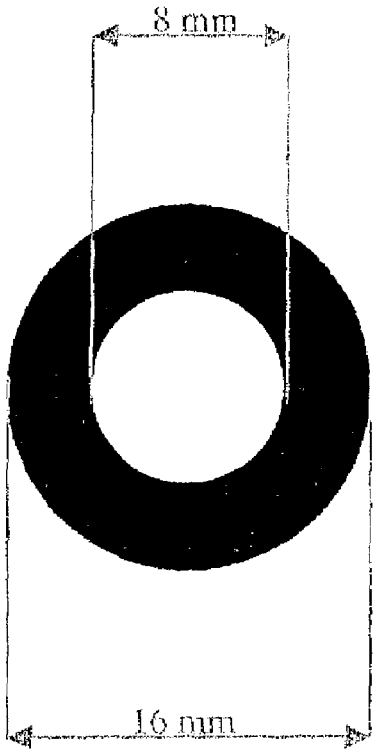
Fig. 1- A
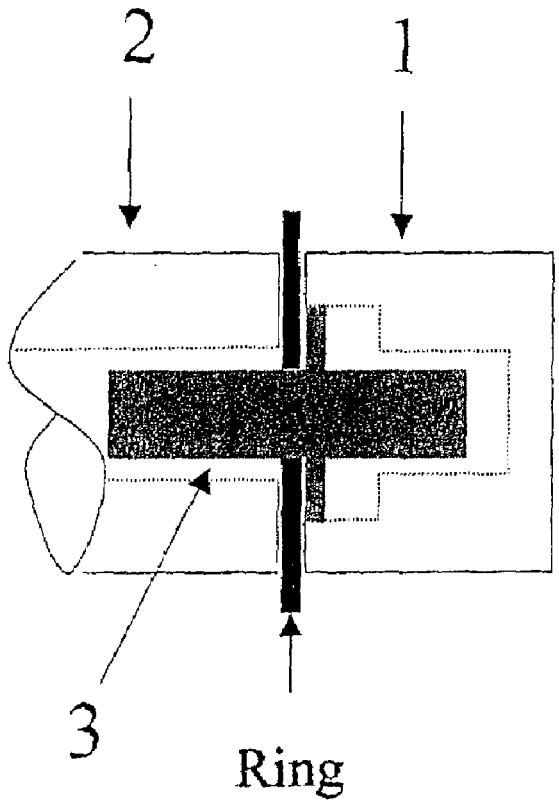
Fig. 1- B (A)

(B)

(A)

(B)

(A)

(B)

WATER SOLUTION USING IN METAL SURFACE TREATING PROCESS AND PROCESS FOR REMOVING OXIDIZED FILM AND BURRED EDGE USING THE SAME

FIELD OF THE INVENTION

The present invention relates to a water solution using in metal surface treating process composed of 0.1 to 5 grams/liter (g/l) of sulfuric acid ions; 5 to 50 grams/liter of fluoride compound; 5 to 50 grams/liter additive; and 30 to 300 grams/liter hydrogen peroxide. Moreover, the present invention relates to a process for removing oxidized film and burred edge of a machining object of harden-treated carbon steel by using the same.

BACKGROUND OF THE INVENTION

Harden-treated carbon steel is cheap and can be tempered and annealed so as to have a preferred flexibility, thus it is Widely used in industry.

Currently, harden-treated carbon steel for fine or thin plate machining objects is treated thermally so as to have a preferred mechanical property and then it is cut mechanically. However after this process, the surface of the machining object is burred and coated with a layer of oxidized film of several tens micros which is dangerous in the succeeding processes. Thereby, they must be removed in advance.

Currently mechanical grinding is used to round the burred edges and removing oxidized films, For example, by grinding with SiC, but this process wastes a longer time. Moreover, the precise of the size and shape of the machining object can not be well controlled and thus the quality of the machining object can be not improved.

SUMMARY OF THE INVENTION

Accordingly, the primary object of the present invention is to provide a water solution using in metal surface treating process being composed of 0.1 to 5 grams/liter of sulfuric acid ions; 5 to 50 grams/liter of fluoride compound; 5 to 50 grams/liter additive; and 30 to 300 grams/liter hydrogen peroxide.

Another object of the present invention is to provide a process for removing oxidized film and burred edge of a machining object of harden-treated carbon steel by using water solution using in metal surface treating process comprising the steps of: defating oil greasy and dirt on the machining object of harden-treated carbon steel; washing the pre-processing agent on the surface of the machining object; placing the washed machining object in a chemical etching tank for chemically etching the machining object; Neutralizing and rusting-proof the surface of the machining object for avoiding oxidation rapidly; and drying the machining object.

The various objects and advantages of the present invention will be more readily understood from the following detailed description when read in conjunction with the appended drawing.

BRIEF DESCRIPTION OF THE DRAWINGS

FIG. 1A is a perspective view showing a thin ring for processed by the process of the present invention.

FIG. 1B is a schematic view showing the ring is assembled to a rotary shaft.

DETAILED DESCRIPTION OF THE PREFERRED EMBODIMENTS

A method for chemical etching is disclosed for taking away oxidized film and removing cut as well as punched edge burs of harden-treated carbon steel. A water solution is added with chemical agents and oxidizing agent. Then burs and oxidizing film are put in a chemical etching bath and then stirred to obtain uniform etched parts. Only a few minutes the oxidized film and the cut edge bur of the harden steel are eradicated. Moreover, the edge can have a round cross section.

In the present invention, the water solution using in metal surface treating process comprises the following elements.

0.1 to 5 grams/liter of sulfuric acid ions which is selected from sulfuric acid and water solvable metal salt of sulfuric acid.

5 to 50 grams/liter of fluoride which is selected from ammonium hydrogen fluoride, sodium sulfuric acid, ammonium fluoride, hydrogen fluoride acid, and water solvable salt of the fluorides. The fluoride can generate hydrogen fluoride in water solution, the hydrogen fluoride compound is selected from ammonium hydrogen fluoride, sodium sulfuric acid, potassium hydrogen fluoride, hydrogen fluoride acid, and ammonium fluoride.

5 to 50 grams/liter additive is selected from urea, thiourea and water solvable salt of above ammonium compound.

30 to 300 grams/liter hydrogen peroxide.

In the following, the components used in the water solution using in metal surface treating process is listed.

| No. | Sulfuric acid ion | Additive | Fluoride | Hydrogen peroxide |
|---|---|---|---|---|
| 1 | 2 g | 5 g | 5 g | 50 g |
| 2 | 4.5 g | 40 g | 45 g | 250 g |
| 3 | 4 g | 35 g | 30 g | 150 g |
| 4 | 3 g | 40 g | 25 g | 90 g |
| 5 | 2.5 g | 30 g | 30 g | 120 g |
| 6 | 1 g | 10 g | 10 g | 50 g |
| 7 | 3.5 g | 25 g | 20 g | 40 g |
| 8 | 1.5 g | 20 g | 20 g | 70 g |
| 9 | 2 g | 45 g | 35 g | 35 g |
| 10 | 1 g | 10 g | 15 g | 65 g |
| 11 | 3 g | 25 g | 45 g | 45 g |
| 12 | 1.5 g | 20 g | 25 g | 25 g |
| 13 | 2 g | 15 g | 10 g | 10 g |
| 14 | 4 g | 30 g | 40 g | 40 g |
| 15 | 3.5 g | 40 g | 15 g | 230 g |

In above example, cases of Nos. 6, 8, 10 and 12 have optimum effect.

Figure 1:
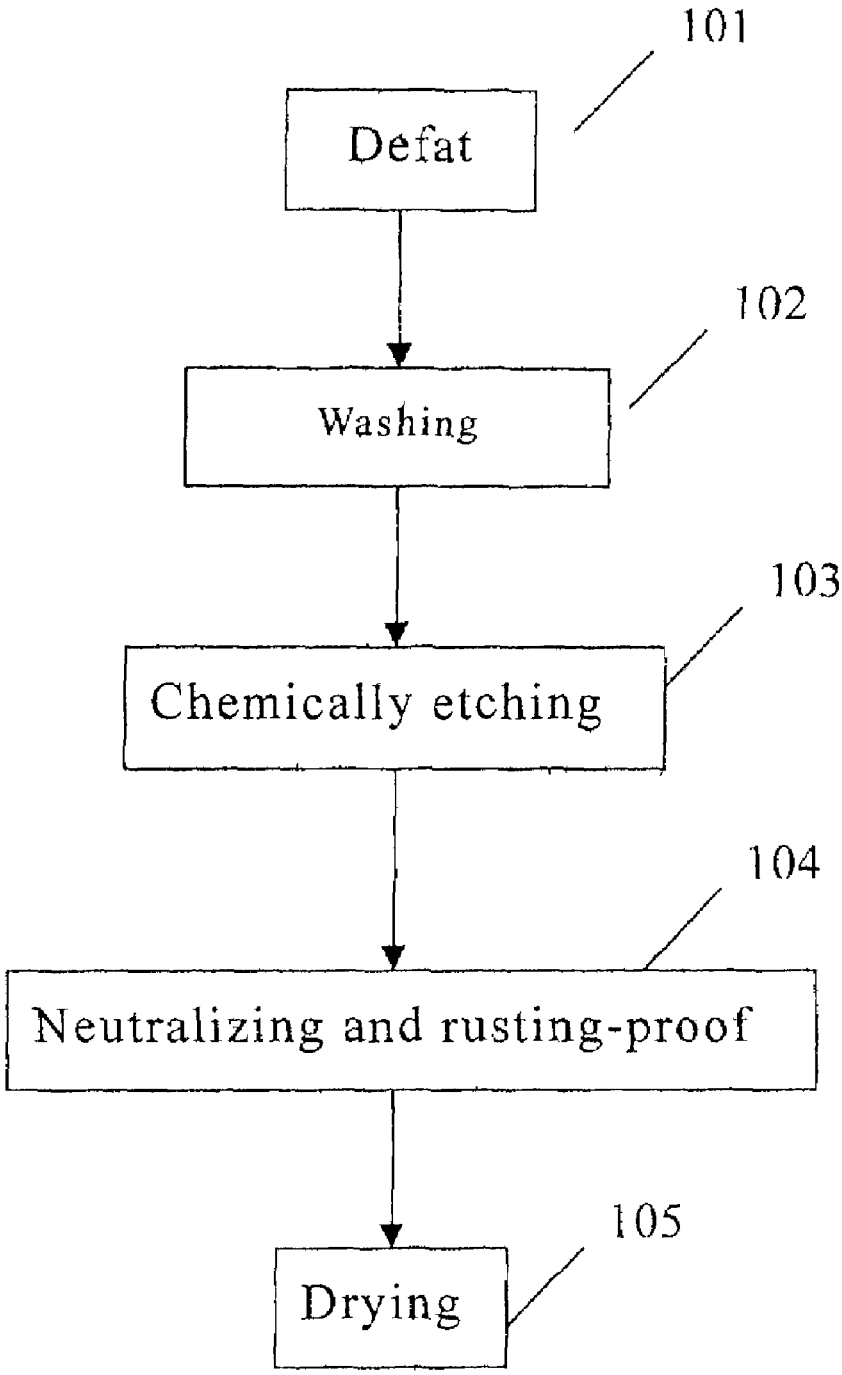
FIG. 1 shows the process of the present invention.

Referring to FIGS. 1, A process for removing oxidized film and burred edges of a machining object of harden-treated carbon steel by using water solution using in metal surface treating process comprises the following steps.

Defating oil greasy and dirt on the machining object of harden-treated carbon steel (step 101);

Washing the pre-processing agent on the surface of the machining object (step 102);

Placing the washed machining object in a chemical etching tank for chemically etching (step 103) the machining object; wherein the etchant in the etching tank is selected from polypropylene (PP), poly chlorine ethylene (PVC), etc. so that the machining object is in contact with the surface of the water solution using in metal surface treating process about 3 to 15 minutes under a temperature of 1° C. to 50° C. The machining object can be sunk in the water solution or is sprayed with the water solution for removing the oxidized film and bur edges;

Neutralizing and rusting-proof the surface of the machining object for avoiding oxidation rapidly (step 104); and Drying the machining object (step 105).

With reference to FIG. 1, in chemically-etching process of the present invention, the surface of the machining object of harden-treated carbon steel is washed and de-greasy. Then the surface of heat processed machining object is cleaned. Then the machining object and the water solution using in metal surface treating process are placed in the chemical etching tank for being stirring mechanically uniformly. Then hydrogen peroxide is added for increasing the potential of the anode while no electric power is applied. Then sulfuric acid and fluoride ions are used to remove the oxidized film and burred edge of the machining object in an acidic solution. Moreover, the thickness of the cross section of the machining object will not apparently reduce due to chemical etching.

By the discharging of the tips in an unprocessed machining object, the charge transfer in tips of the machining object is rapider than in surface area thereof, and thus the deionization of the anode is speeded so as to round the edges.

One embodiment of the present invention will be described hereinafter, however the present invention is not confined by this embodiment, but is defined by those described in the claims.

Referring to FIGS. 1A and 1B, a thin ring is punched and then thermally processed so that the oxidized film and cut surface are exposed out, and then are assembled to a rotary means (referring to FIG. 1B), in that the ring is fixed to a shaft 3 and are clamped between a front clamping unit 2 and a rear clamping unit 1.

Figure 2:
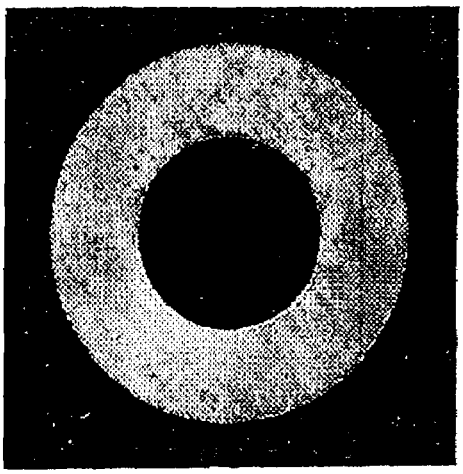
FIG. 2A is a schematic view showing the surface of the machining object before chemical etching.
FIG. 2B is a schematic view showing the surface of the machining object before chemical etching.
Figure 2:
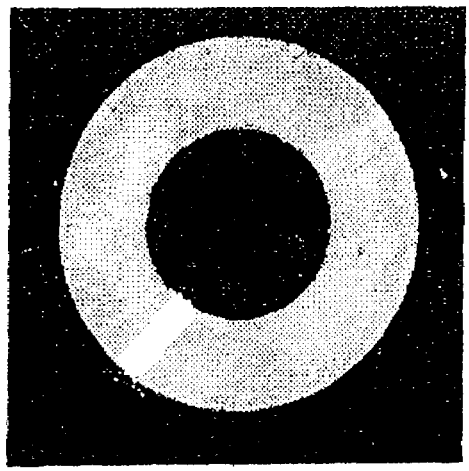
Figure 3:
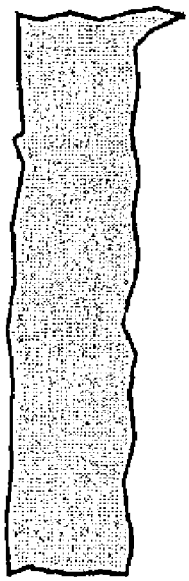
FIG. 3A is a schematic view showing that the cross section of a machining object having burred edges.
FIG. 3B is a schematic view showing the cross section of FIG. 3A which has been etched.
Figure 3:
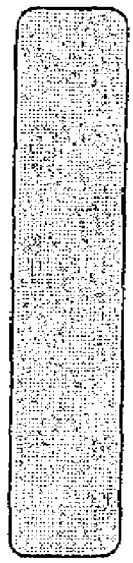

The ring is placed in a water solution using in metal surface treating process and then is rotated under a rotary speed of 100 rpm. It is found that the oxidized film having a thick of 15 micro on the surface of the ring is removed within 3 minutes (referring to FIGS. 2A and 2B). Meanwhile, by tip discharging, the burred edge of the ring is deionized speedily (referring to FIG. 3A and 3B).

Figure 4:
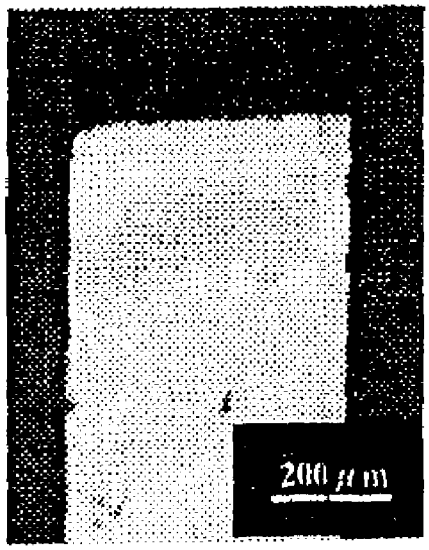
FIG. 4A is a cross section view showing that the burred edges of a punched plate is not removed.
FIG. 4B is a schematic view showing that the burred edges in FIG. 4A has been removed.
Figure 4:
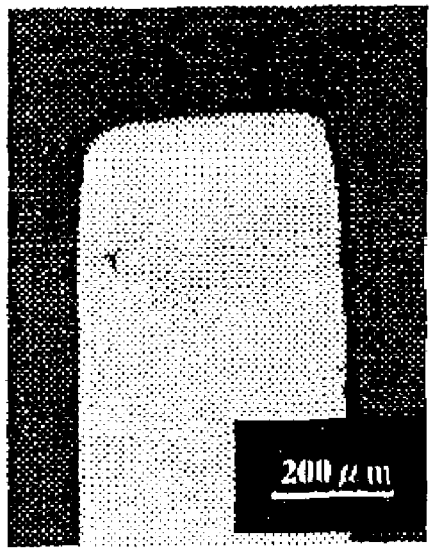

Besides, the ring is sunk in the water solution using in metal surface treating process about 5 to 15 minutes. Referring to FIGS. 4A and 4B, burred edges of the ring are rounded, while the thickness of the ring is only slightly reduced with a value below 0.2 mm. Thereby, the structural strength is retained.

Figure 5:
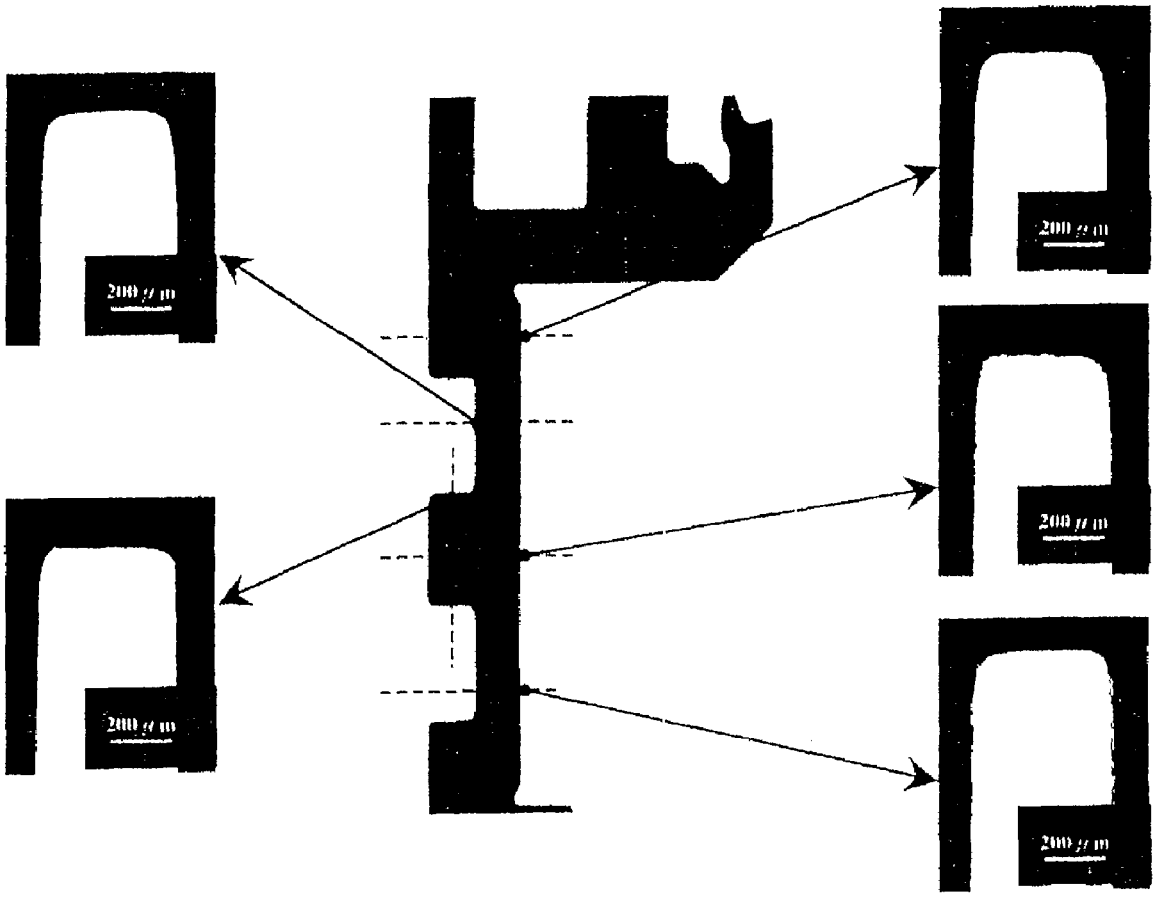
FIG. 5 is a schematic view showing the process for removing the burred edges of a plate and the edges thereof being removed.

Furthermore, as shown in FIG. 5, it is illustrated that a plate object is sunk in the water solution using in metal surface treating process and vibrates longitudinally about 15 minutes. The oxidized film can be removed within 5 minutes. From the figures at the peripheries, it is shown that the edges of the plate is rounded. Thus, the rounding edge effect is apparent by using the water solution of the present invention.

Thereby, in the present invention, a method for chemical etching is disclosed for taking away oxidized film and removing cut as well as punched edge bur of harden-treated carbon steel (SK3, SK4 and SK5) Thereby, the fillet edge of the cut section is achieved. An oxidized film with a thickness of several micrometers is formed when a cut and punched steel is quenched and tempered at high temperature. Due to high strength and hardness of the steel, the oxidized film and edge bur are difficult to be removed by mechanical grinding. Therefore, a suitable electrolyte composes of only a little chemical reagent and oxidizer in deionized water is used to remove the oxidized film and punched bur simultaneously using chemical etching method.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A water solution using in metal surface treating process being composed of 0.1 to 5 grams/liter of sulfuric acid ions; 5 to 50 grams/liter of fluoride compound; 5 to 50 grams/liter additive; and 30 to 300 grams/liter hydrogen peroxide;

wherein the sulfuric acid ions is selected from at least one of sulfuric acid and water solvable metal salt of sulfuric acid;

wherein the fluoride compound is selected from at least one of ammonium hydrogen fluoride, potassium hydrogen fluoride, hydrogen fluoride acid, and water solvable salt of above components;

wherein additive is selected from at least one of urea, thiourea and water solvable salt of above ammonium.

2. The water solution using in metal surface treating process as claimed in claim 1, wherein the water solution is composed of 1 grams/liter of sulfuric acid ions; 10 grams/liter of fluoride compound; 10 grams/liter additive; and 50 grams/liter hydrogen peroxide.

3. The water solution using in metal surface treating process as claimed in claim 1, wherein the water solution is composed of 1.5 grams/liter of sulfuric acid ions; 20 grams/liter of fluoride compound; 20 grams/liter additive; and 70 grams/liter hydrogen peroxide.

4. The water solution using in metal surface treating process as claimed in claim 1, wherein the water solution is composed of 1 grams/liter of sulfuric acid ions; 15 grams/liter of fluoride compound; 10 grams/liter additive; and 65 grams/liter hydrogen peroxide.

5. The water solution using in metal surface treating process as claimed in claim 1, wherein the water solution is composed of 1.5 grams/liter of sulfuric acid ions; 25 grams/liter of fluoride compound; 20 grams/liter additive; and 75 grams/liter hydrogen peroxide.

* * * * *